US010011984B2

(12) United States Patent
Verraes

(10) Patent No.: US 10,011,984 B2
(45) Date of Patent: Jul. 3, 2018

(54) PARTITION SYSTEM FOR A PARTITION OF WOODEN BEAMS

(71) Applicant: WOV, BESLOTEN VENNOOTSCHAP MET BEPERKTE AANSPRAKELIJKHEID, De Pinte (BE)

(72) Inventor: Wolfgang Pol Jozef Verraes, De Pinte (BE)

(73) Assignee: WOV, BESLOTEN VENNOOTSCHAP MET BEPERKTE AANSPRAKELIJKHEID, De Pinte (BE)

( * ) Notice: Subject to any disclaimer, the term of this patent is extended or adjusted under 35 U.S.C. 154(b) by 0 days.

(21) Appl. No.: 14/902,192

(22) PCT Filed: Jun. 2, 2014

(86) PCT No.: PCT/BE2014/000026
§ 371 (c)(1),
(2) Date: Dec. 30, 2015

(87) PCT Pub. No.: WO2015/000039
PCT Pub. Date: Jan. 8, 2015

(65) Prior Publication Data

US 2016/0153188 A1 Jun. 2, 2016

(30) Foreign Application Priority Data

Jul. 2, 2013 (BE) ..... 2013/0460

(51) Int. Cl.
*E04B 2/70* (2006.01)
*E04B 1/35* (2006.01)
(Continued)

(52) U.S. Cl.
CPC ..... *E04B 2/70* (2013.01); *E04B 1/348* (2013.01); *E04B 1/40* (2013.01); *E04B 2/703* (2013.01);
(Continued)

(58) Field of Classification Search
CPC .... E04B 1/40; E04B 2001/3583; E04B 2/703; E04C 2/14; E04C 3/145
See application file for complete search history.

(56) References Cited

U.S. PATENT DOCUMENTS 1,972,475 A * 9/1934 Davison ..... E04B 2/7448 52/281
2,587,804 A * 3/1952 Ajne ..... E04B 1/26 292/240
(Continued)

FOREIGN PATENT DOCUMENTS

BE 1 019 061 A3 2/2012
CA 2320340 A1 * 6/2000 ..... E04B 1/10
(Continued)

OTHER PUBLICATIONS
International Search Report, dated Sep. 15, 2014, from corresponding PCT application.

*Primary Examiner* — Christine T Cajilig
(74) *Attorney, Agent, or Firm* — Young & Thompson

(57) ABSTRACT

Partition system for assembling a partition (3) such as a wall, that is composed of wooden beams (4) with two side faces (8,9) opposite one another extending in the longitudinal direction that determine the width of the beam (4) and with which the beams (4) can be assembled adjacent to one another, wherein connecting pieces (5) are provided to be fitted between adjacent beams (4) in order to keep the beams (4) from one another with a certain clearance (S) in the assembled state and that the connecting pieces (5) are kept at a fixed or practically fixed distance from one another by spacers (6).

23 Claims, 9 Drawing Sheets

(51) Int. Cl.
*E04B 1/348* (2006.01)
*E04B 1/41* (2006.01)
*E04C 3/02* (2006.01)

(52) U.S. Cl.
CPC ..... *E04C 3/02* (2013.01); *E04B 2001/3583* (2013.01)

(56) References Cited

U.S. PATENT DOCUMENTS 3,820,293 A * 6/1974 Ohe et al. ..... E04B 1/2604 52/127.12
5,471,804 A * 12/1995 Winter, IV ..... E04B 1/14 403/231
5,912,440 A * 6/1999 Murakami ..... E04C 2/14 181/210
6,266,934 B1 7/2001 Houseal
7,596,916 B1 * 10/2009 Anderson ..... E04B 2/702 52/233
2002/0014050 A1 * 2/2002 Van Der Heijden ..... E04B 2/08 52/585.1
2008/0115455 A1 * 5/2008 Nadon ..... E04B 1/3205 52/798.1

FOREIGN PATENT DOCUMENTS

DE 3443269 A1 * 5/1986 ..... E01F 8/0088
EP 0 787 866 A1 8/1997
FR 2 713 257 A1 6/1995
JP 5425323 B1 * 2/2014 ..... E04B 1/10

* cited by examiner

PARTITION SYSTEM FOR A PARTITION OF WOODEN BEAMS

BACKGROUND OF THE INVENTION

Field of the Invention

The present invention relates to a partition system for assembling a partition such as a wall, floor, ceiling, sheet or similar, whereby this partition is composed of wooden beams that are placed next to and parallel to one another with a close fit to form a continuous flat partition.

On account of the limited buckling strength of wooden beams they are stacked on one another in a horizontal position to assemble a vertical partition.

The beams are generally connected together by means of dowels or wooden pegs or pins that are pressed into holes that are transverse to the longitudinal direction of the beam and which are provided to this end in the side faces of the beams oriented towards one another, more specifically a head face and a tail face, such that each dowel is inserted into each beam to be connected by a certain length with an interference fit.

While it is known that wooden beams are generally reasonably dimensionally stable in their longitudinal direction, it is also known that wooden beams have a tendency to contract widthways transverse to the longitudinal direction due to drying out, and to expand when the wood absorbs moisture in a damp atmosphere.

A measure of the moisture present in the wood is often expressed as the wood moisture content or the water content of the wood that expresses the percentage ratio between the weight of the moisture in the wood and the weight of completely dry wood.

It is a known fact that a change of the wood moisture content of 1% can bring about an expansion or contraction of around 3% of a solid wooden beam.

The wood moisture content of beams used for the partitions of a house with a wooden frame construction can easily fluctuate between 8% and 15%, which can bring about important fluctuations of the width of the beams.

An important disadvantage of these known partitions made from wooden beams is that they are not dimensionally stable.

As a result stability problems can occur and/or air leaks, sound leaks or visually unpleasant cracks between the beams can occur that are the result of the cumulative contraction or expansion of the composite beams. Moreover, such partitions give rise to undesired creaking noises.

In order to limit the problem of widthways contraction and expansion, use is sometimes made of cross-laminated sheets or beams that are made from sheets of wood glued on one another whereby the grain direction of successive wooden layers is crossed.

However, such sheets and beams are expensive and can substantially increase the costs of a new construction.

In large cross-laminated sheets the necessary parts have to be sawn out for openings for windows, doors and similar, which entails a lot of waste.

In addition, with such sheets it is very difficult to invisibly affix pipe ducts and anchor points and assembly fittings.

Description of the Related Art

Partition systems are already known from BE 1.019.061 and EP 0.787.866 for composing a partition of wooden beams with two side faces opposite one another extending in the longitudinal direction that determine the width of the beam, respectively a head face and a tail face with which the beams can be assembled adjacent to one another and which can be coupled together by means of connecting pieces that are affixed between adjacent beams and which are connected together by means of coupling pieces that extend through passages in the beams in line with one another.

In these partition systems, during assembly of the partition the coupling pieces are tightened so firmly that in the assembled state the beams rest on one another without any clearance and the beams consequently have no room to freely expand when the wood becomes more moist during the life of the partition than at the time of the assembly of the partition.

In the technical field concerned it is evidently assumed that during the life of a house no expansions of the width of the wooden beams occur.

Nevertheless, if during construction of a house the beams are exposed to bright sunshine for a number of days and the humidity then increases, it is inevitable that the beams will expand across their width.

In the case of the aforementioned documents the beams are pushed upwards by the underlying beams due to the combined expansions of the underlying beams. This can give rise to the occurrence of a crack above a window because the beam that runs above the window is pushed upwards while the height of the window remains practically unchanged.

Also when the beams contract a problem can occur because then the weight of the roof or another structure that rests on the partition is then completely on the top connecting piece and coupling piece, which can lead to the continuous succession of coupling pieces and connecting pieces bending as is indeed recognised in EP 0.787.866.

BRIEF SUMMARY OF THE INVENTION

The purpose of the present invention is to provide a solution to at least one of the aforementioned and other disadvantages.

To this end the invention concerns a partition system for assembling a partition, in particular a wall, floor, ceiling or sheet, that is composed of wooden beams with two side faces opposite one another extending in the longitudinal direction that determine the width of the beam, respectively a head face and a tail face with which the beams can be assembled adjacent or next to one another and which can be coupled together by means of connecting pieces that are affixed between adjacent beams and which are connected together by means of coupling pieces that extend through passages in the beams in line with one another, whereby the connecting pieces comprise an intermediate disk, whereby these intermediate disks are provided to be fitted between the side faces of adjacent beams in order to keep the beams from one another with a certain clearance in the assembled state in order to provide room for the beams to be able to expand widthways at the location of the clearances and whereby the coupling pieces are constructed as spacers between the connecting pieces to ensure that the intermediate disks are kept at a predetermined fixed or practically fixed distance from one another.

In this way the beams are kept in their mutual places as it were and the beams, due to the clearance, can freely expand widthways without them upsetting one another, or can freely contract widthways without large cracks being able to occur. Indeed, although the clearance between adjacent beams can indeed vary, for example with the humidity, the clearances between adjacent beams are retained as it were by the spacers at the location of the connecting pieces without the clearances being able to accumulate.

This provides the advantage that for building vertical partitions of a building, vertical beams can also be used with a length of three meters for example, in order to be able to span the entire height of a storey, whereby these vertical beams are held together by spacers and connecting pieces that are affixed horizontally.

Such vertical partitions are highly dimensionally stable in the vertical direction thanks to the inherent dimensional stability of the beams in their longitudinal direction, but also along their width thanks to the connecting pieces and spacers, which as it were form a horizontal reinforcement that also provide strengthening against buckling, such that such partitions can form a stable structure for supporting floors and roofs.

Thanks to the dimensional stability across the width the setting of the wall in the horizontal direction is prevented such that problems with joining to doors and windows, detachment or cracking of wall coverings and pipes are prevented.

Moreover, the use of dowels is as good as superfluous as the connecting pieces and spacers already fulfil this function, although the use of dowels is not excluded.

Thanks to the invention partitions can be built making use of cheaper beams that are less dimensionally stable across their width when used in a partition of a house or another building, for example solid wooden beams or laminated beams with layers whose grains are not crossed and which essentially extend in the longitudinal direction of the beam.

This provides the advantage that cheaper beams can be used than the more expensive more dimensionally stable cross-laminated beams, and this without a risk of undesired deformations, although the invention is of course not limited to these cheaper beams. Solid beams also have the advantage of being more ecological than laminated beams.

Another advantage is that by using beams, partitions can be assembled in a simple way without using lifting devices or other special tools, except perhaps a cut-off saw to saw the beams to length, such that the partition system is also suitable for the do-it-yourselfer.

Preferably the spacers are kept at a distance from one another that is such that the distance between centres of two successive connecting pieces on either side of a beam is equal to the width between the head face and tail face of the beam concerned at the location of the connecting pieces, plus the aforementioned clearance and this with a given wood moisture content of preferably around 10% and a clearance of preferably around 2% of this width.

In this way problems of undesired deformations are guaranteed to be eliminated with the usual fluctuations of wood moisture content that we can encounter in our regions.

Preferably the intermediate disks are dimensioned, for example with a small diameter, such that when the width of the beams at the level of the passages becomes larger than the predetermined fixed distance between the intermediate disks due to expansion, these intermediate disks can push into the material of the beams by local upsetting of the material of the beams.

As a result, in the event of increasing humidity the beams can expand widthways without pushing each other away sideways, such that in this case too the dimension of the partition in the widthways direction of the beams is dimensionally stable.

Preferably the coupling pieces and connecting pieces are connected together by means of a screw connection with a maximum travel that is such that the aforementioned predetermined distance between the intermediate disks is reached when the coupling pieces and connecting pieces are screwed into one another over their maximum travel.

This substantially facilitates the assembly of the partition as the fitter just has to fully screw the coupling pieces and connecting pieces into one another in order to realise the predetermined fixed distance between the intermediate disks, without him having to be concerned with any measurements. This provides the additional advantage that assembly errors are all but ruled out.

Preferably one side face of each beam is provided with at least one groove and the other side face is provided with at least one tongue, whereby the aforementioned tongue and groove have a complementary shape, such that the groove and tongue can engage with a respective tongue and groove of a similar adjacent element to form a partition or wall, with a clearance in the widthways direction of the beam between a tongue concerned and groove concerned engaging therewith.

Thus the clearance between adjacent beams is bridged by a tongue and groove connection, which, due to the clearance between the tongue and groove, also enables the beams to contract and expand with respect to one another unimpeded.

Preferably there are at least two tongue and groove connections between two beams and the connecting pieces are concealed invisibly between two such connections.

Moreover, it is also hereby possible to affix other connecting pieces such as shutter anchors between two tongue and groove connections of two adjacent beams.

Preferably a seal is clamped between a tongue and groove that extends over the length of the groove and which is made from an elastic compressible material, for example foam rubber or similar, such that the airtightness of the partition is guaranteed, and moreover undesired creaking and rattling of the beams is prevented.

BRIEF DESCRIPTION OF THE DRAWINGS

With the intention of better showing the characteristics of the invention, a preferred embodiment of a partition according to the invention is described hereinafter by way of an example, without any limiting nature, with reference to the accompanying drawings, wherein.

DETAILED DESCRIPTION OF THE PREFERRED EMBODIMENTS

Figure 1:
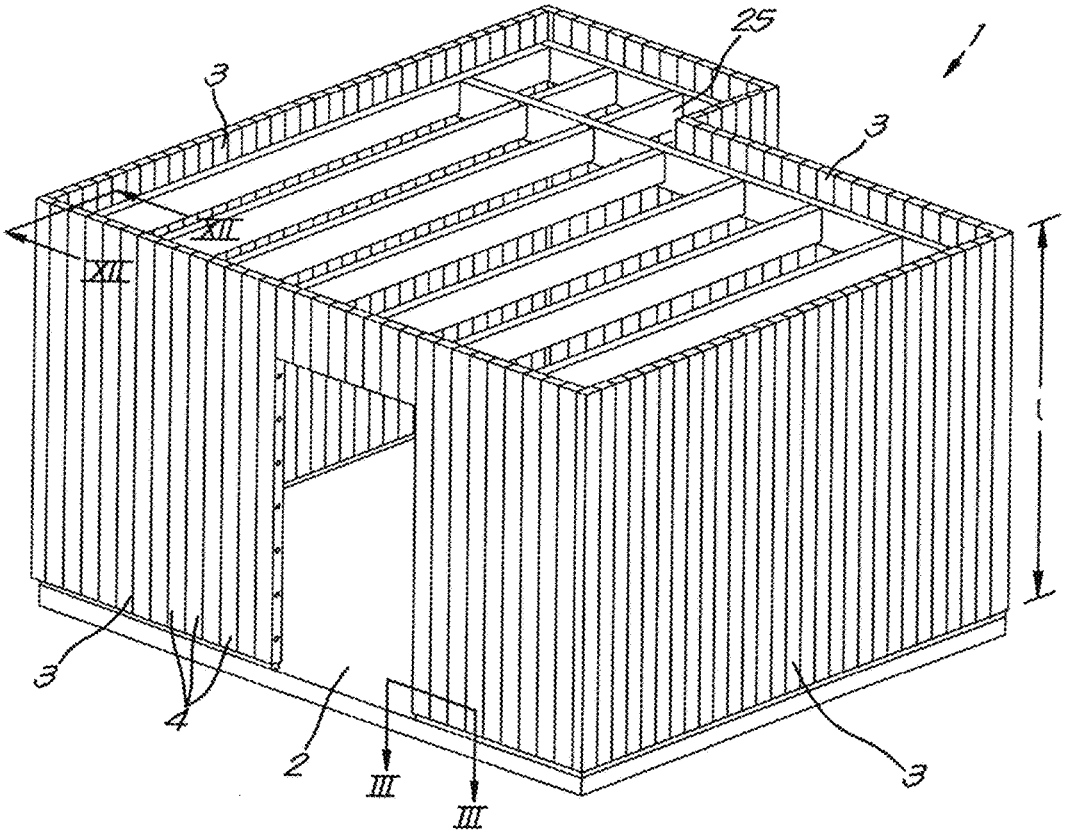
FIG. 1 schematically shows a perspective view of a house under construction with a partition system according to the invention.
Figure 2:
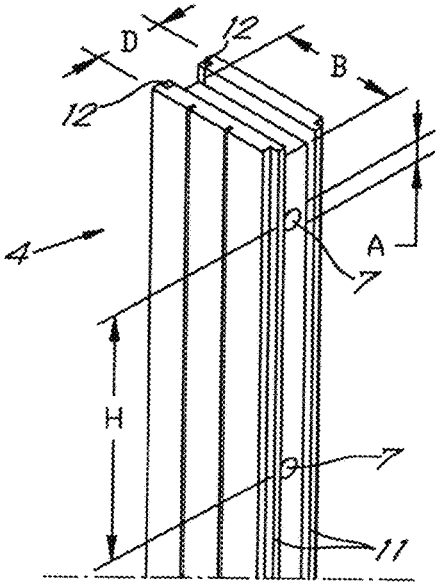
FIG. 2 shows a section of a wooden beam as used for assembling the partitions of FIG. 1.

The partially constructed house 1 or building of FIG. 1 is formed by a concrete floor slab on which partitions 3 are erected that are composed of wooden profiled beams 4, for example of solid wood, with a length 1 of 3 meters for example to be able to span the height of a storey.

Figure 3:
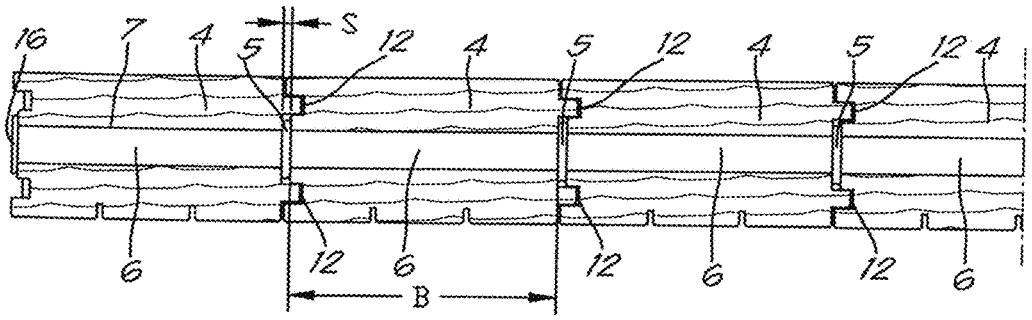
FIG. 3 shows connect beams.
Figure 4:
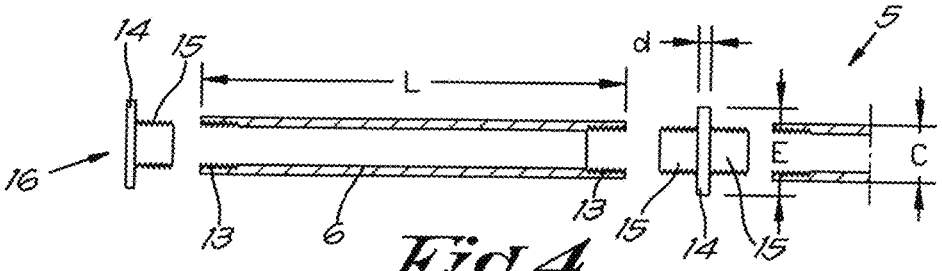
FIG. 4 shows connecting pieces and spacers used for assembling the partitions of FIG. 1.

These beams 4 are erected vertically next to one another along their length 1 and connected together by means of connecting pieces 5 and coupling pieces 6, as illustrated in FIG. 4, which, as shown in FIG. 3, are affixed through passages 7 that extend in the width B of the beams 4 between two side faces, respectively a head face 8 and a tail face 9.

The passages 7 have a diameter A and are distributed evenly over the length 1 of the beams 4 with equal distances between centres H of 15 cm for example.

The beams 4 have a thickness D of 8 cm for example and a clear width B of 15 cm, for example, that is determined as the distance between the head face 8 and the tail face 9 at the location of the passages 7 in the free unassembled situation of the beams 4.

The tail face 9 is provided with two grooves 10 that extend over the length 1 of the beams 4 on either side in the widthways direction of the passages 7, while the head face 8 is provided with tongues 11 extending over the length 1 that have a shape that is more or less complementary to that of the grooves 10 so that the tongues 11 can grip in the grooves 10 of an adjacent beam in a head-tail connection.

A seal 12 can be provided in the grooves 10 that extends over the length 1 of the groove 10 and which is compressible between the tongues 11 and base of the grooves 10.

In this case the coupling pieces 6 illustrated in FIG. 4 are formed by a rod in the form of a threaded tube, with a diameter C that is practically equal to the internal diameter A of the passages 7, and with female screw thread sections 13 at both ends.

In this case, the length L of these spacers is equal to the aforementioned width B of the beams 4 at the location of the passages 7 and this in the unassembled state of the beams and with a given wood moisture content of the wood of the beams 4, which for example is between 9 and 11%, preferably with a wood moisture content of 10%.

The connecting pieces 5 as illustrated in FIG. 4 are formed by an intermediate disk 14 with a diameter E that is larger than the diameter A of the passages 7 and a thickness d with coaxially affixed male screw thread sections 15 on either side of the intermediate disk 14 that can engage with the aforementioned female screw thread sections 13 of the spacers 6.

Furthermore, at a beginning or at an end of a partition 3 an end piece 16 is used, consisting of a disk 14 and a male screw thread section 15 on one side of the disk 14.

The spacers 6 and connecting pieces 5 are made of a material such as metal that is as good as dimensionally stable and thus is little sensitive to moisture, if at all, with regard to shape and dimensions.

The screw connections between the screw thread sections 13 and 15 are characterised by a maximum travel that is reached by screwing the connecting pieces 5 over a maximum depth into the coupling pieces 6, for example until the intermediate disk 14 comes against the end of the threaded tube.

A coupling piece 6 thus plays the role of a spacer 6 between the intermediate disks 14, which in the case of the embodiment of FIG. 4 keeps the intermediate disks 14 at a distance L from one another that is equal to the length L of the threaded tube.

The construction of a partition 3 is very simple and is illustrated on the basis of FIGS. 5 to 8.

Figure 5:
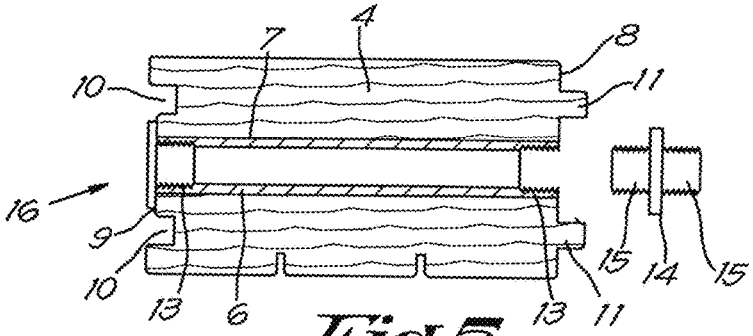
FIGS. 5 to 8 illustrate the method for assembling the partitions that are shown in FIG. 1.

First a spacer 6 is fully screwed to against the intermediate disk 14 on an end piece 16 and the spacer 6 is inserted in a passage 7 through a beam 4 as shown in FIG. 5.

Figure 6:
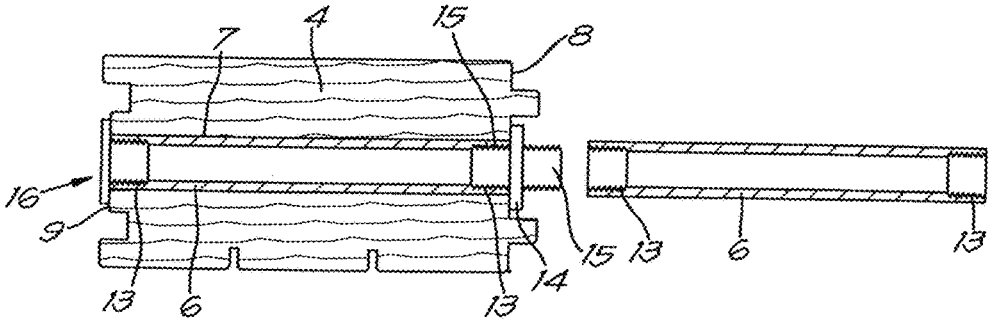

Then a first connecting piece 5 is fully screwed in the spacer 6 present in the beam 4 as shown in FIG. 6, so that the distance between the disks is equal to the aforementioned length L of the spacers 6 corresponding to the clear width B of the beam 4 at the level of the intermediate disks with a given wood moisture content of 10% for example.

When the wood moisture content of the wood of the beams 4 used is less than the given wood moisture content of 10% for example, then at that time the width of the beams 4 will be less than the length L and in other words the beams 4 will be held with a small sideways clearance between the intermediate disks 14 of the end piece 16 and the first connecting piece 5.

When the wood moisture content is greater than the aforementioned 10%, the width of the beams 4 will be greater than the length L and when screwing the first connecting piece 5, the intermediate disk 14 of this first connecting piece 5 will be pulled into the wood slightly by the local upsetting of the material of the beam 4, preferably due to the elastic upsetting of this material.

Figure 7:
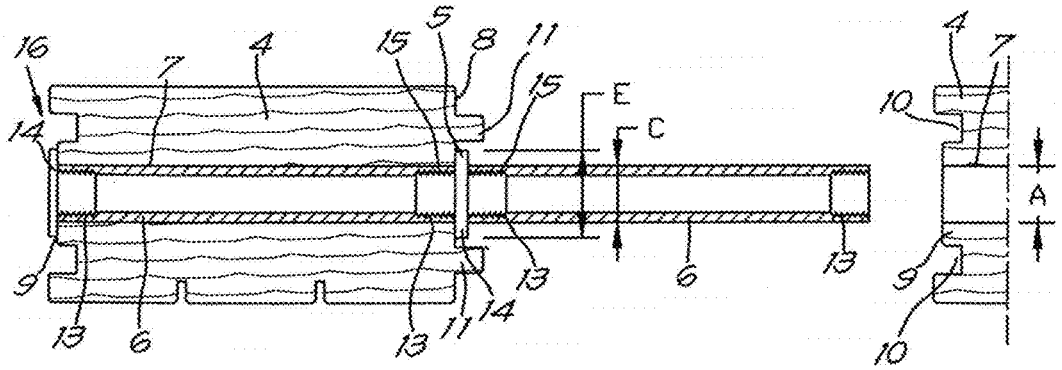
Figure 8:
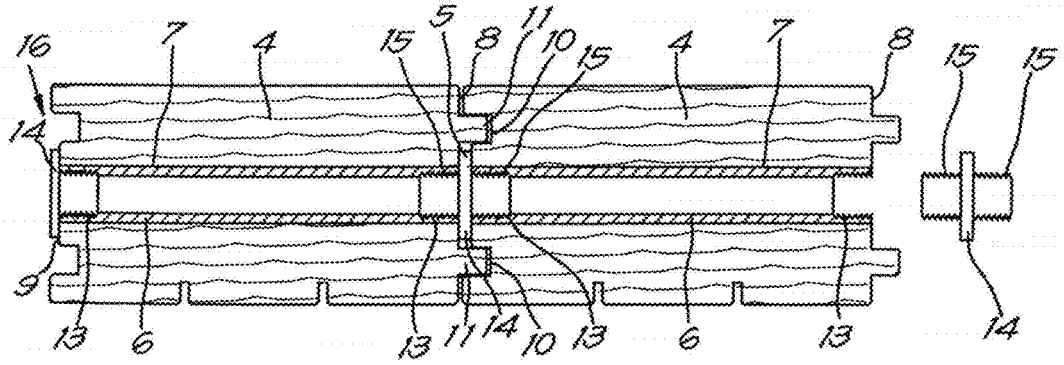

Then a subsequent spacer 6 is affixed, as shown in FIG. 7, and a subsequent beam 4 with a corresponding passage 7 is slid over this spacer 6 up to against the first connecting piece 5, as shown in FIG. 8.

Then a second connecting piece 5 is fitted and the steps of FIGS. 7 and 8 are repeated for each additional beam 4 until the desired width of the partition is obtained, after which an end piece 16 is screwed into the last fitted spacer 6.

In this way the beams 4 of the partition are held together by a series of spacers 6 that connect the connecting pieces 5 mutually and the end pieces 16 together, and which extend in line with one another over the entire width of the partition 3.

In this way connecting pieces 5 and spacers 6 can be fitted simultaneously at two or more heights of the partition 3, for example through the bottom and the top passages 7 of the beams 4.

For the parts of the partitions to span openings for windows, doors or similar, shorter pieces can be sawn to length and connected in the same way with connecting pieces and spacers above and/or below the opening.

A house 1 can thus be fully erected making use of one type of standard beam 4 with a raster of holes that are shortened to size, and which are held together as described. The contractor then only has to have a limited number of types of components in stock. Moreover, very little waste is lost as the sawn off lengths can be re-used in other places.

In summary the invention also concerns a construction system for a house with beams and continuous spacers in linked elements with which larger plates or sheets can be assembled.

It is clear that the thickness d of the disks 14 of the connecting pieces 5 determines the clearance S between two adjacent beams 4 at the location of the passages 7. At a wood moisture content of 10% this clearance S will be equal to the thickness d of these disks 14.

The thickness d of the disks is preferably chosen such that the aforementioned clearance S with the given wood moisture content of 10%, for example, is between 1% and 3% of the width B of the beams with this wood moisture content, and preferably is of the order of magnitude of 2%, for example 3 mm.

This gives sufficient clearance to allow the beams 4 to expand and contract widthways unimpeded without undesired deformations and cracks, whereby the clearances at the location of the intermediate disks 14 are retained such that the clearances are spread evenly over the width of the wall without the clearances being able to accumulate at one specific place.

Figure 9:
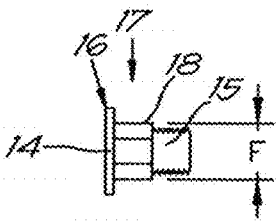
FIGS. 9 and 10 show variants of the connecting pieces of FIG. 4.
Figure 10:
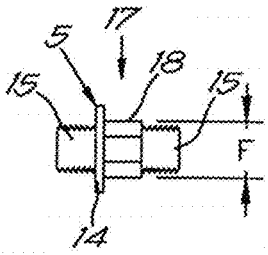

FIGS. 9 and 10 describe variant embodiments of connecting pieces 5 and end pieces 16, which differ from those of FIG. 4 by the fact that they are provided with means 17 to prevent the turning of the fitted end pieces 16 and connecting pieces 5 and/or spacers 6 when tightening a subsequent connecting piece 5 or a subsequent spacer 6.

In the example shown these means 17 are formed by a nut 18, for example a hexagonal nut that is connected in an unturnable way to the screw thread parts 15 of the connecting piece 5 and the end piece 16 and whose external diameter F is greater than the internal diameter A of the aforementioned passages 7 in a beam 4.

Figure 12:
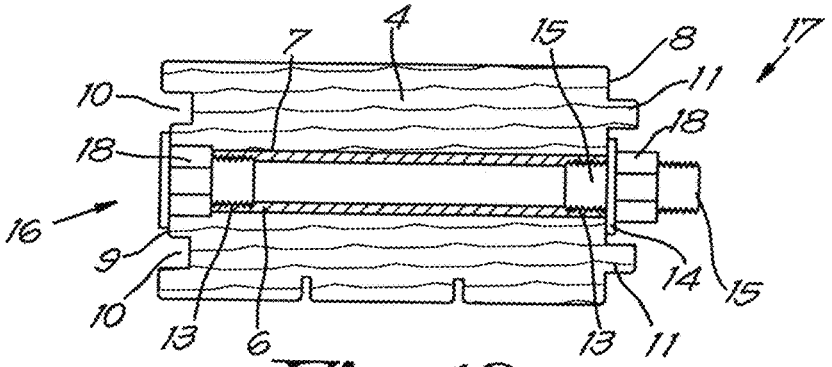
FIG. 12 shows a situation as that of FIG. 5 but with the connecting pieces of FIGS. 9 and 10.

This nut 18 enables the connecting pieces 5 to be firmly screwed in the spacers and, simultaneously the corners 19 of the nut 18 of an end piece or connecting piece already in place to be pulled in the wood when screwing in firmly, as illustrated on the basis of FIG. 12, such that the co-turning of such an end piece or connecting piece already in place is prevented.

Although in the examples the connecting pieces 5 are made from a single part, it is not excluded that such a connecting piece 5 can be made from two or more separate components.

Figure 11:
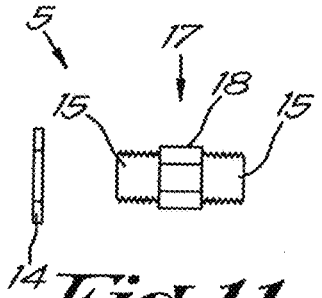
FIG. 11 shows a variant of FIG. 10.

FIG. 11 shows such an example whereby the intermediate disk 14 of the connecting piece 5, with respect to the embodiment of FIG. 10, is constructed as a separate ring.

It is not excluded either that a spacer 6 and a connecting piece 5 for example are connected immovably together at one end of the spacer 6 or are constructed as a single piece.

Figure 13:
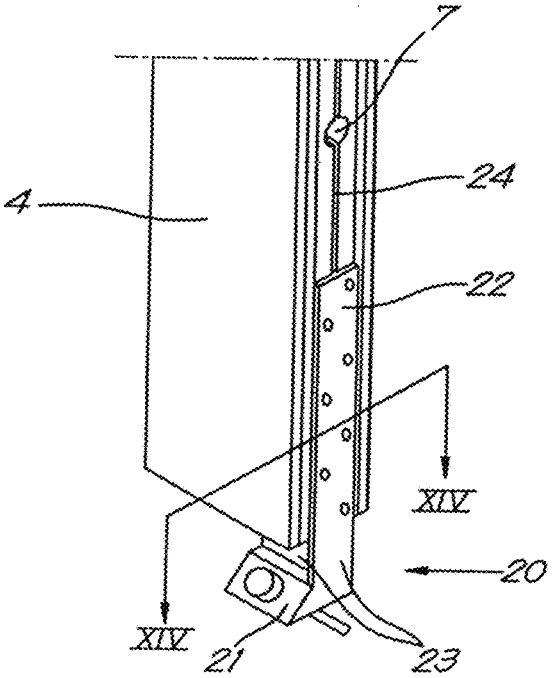
FIG. 13 shows a variant of a wooden beam according to the invention with an anchor also applied.
Figure 14:
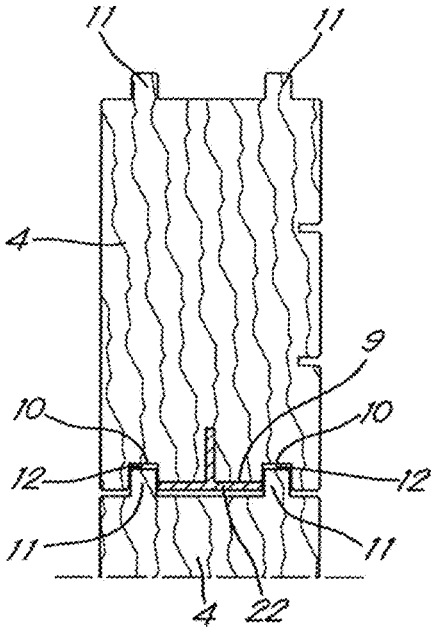
FIG. 14 shows a cross-section according to line XIV-XIV of FIG. 13.

In order to anchor the partitions 3 to the floor slab 2 use is preferably made of anchors 20, as shown in FIGS. 13 and 14, consisting of a base 21 for fastening the anchor 20 to the floor slab 2 and an upward oriented T-profile 22 with two upright slats 23 transverse to one another, of which one slat 23 is held in a slot 24 that is provided to this end in the tail surface 9 and which extends between the grooves 10 along the length of the beam 4, while the other slat is concealed in the clearance between two beams, as can be seen in the cross-section of FIG. 14.

The construction of FIG. 1 is provided with a supporting structure 25 for the floor of a storey. A second and subsequent storeys can be provided in an analogous manner for a house or building with a number of storeys.

Figure 15:
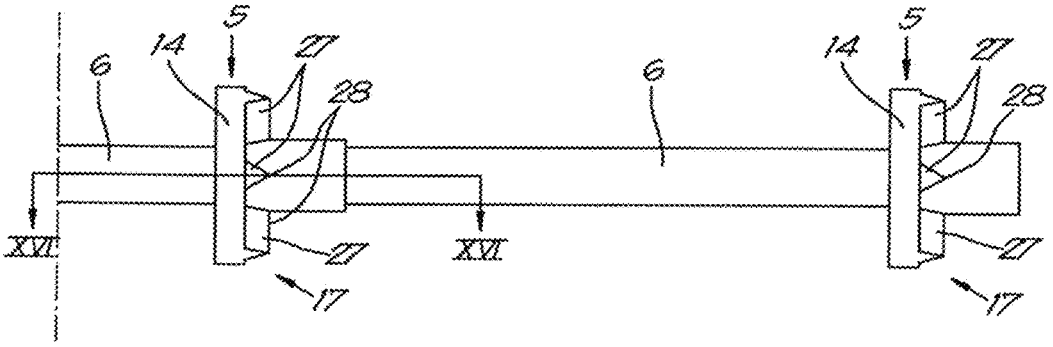
FIG. 15 shows a different embodiment of connecting pieces and spacers.

FIG. 15 describes an alternative embodiment of a composition of connecting pieces 5 connected by coupling pieces 6 in the form of spacers 6.

Figure 16:
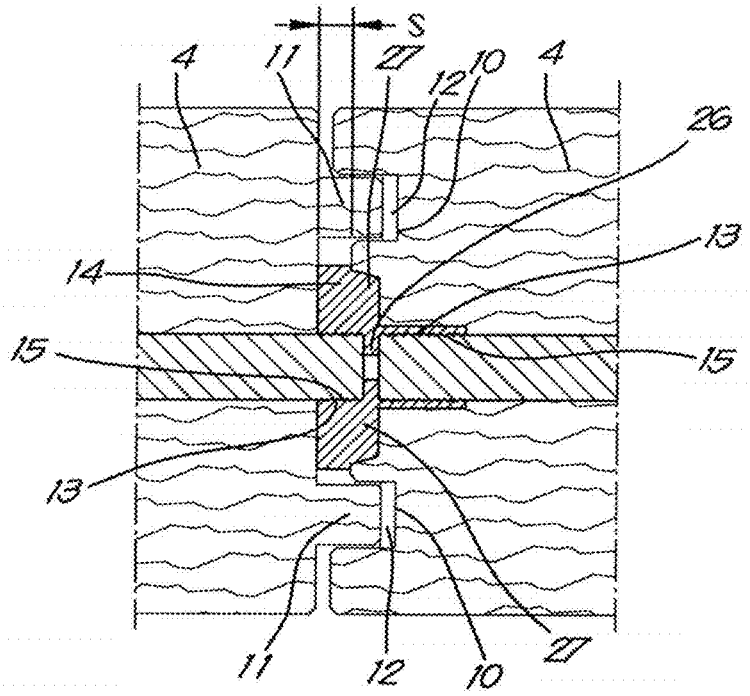
FIG. 16 shows a cross-section according to line XVI-XI, but fitted in a partition.

As can be seen in the cross-section of FIG. 16, in this case the spacers 6 are constructed as threaded rods with at least a male screw thread section 15 at the ends that can engage with a female screw thread section 13 of the connecting pieces 5, that are separated from one another by a rabbet 26 for screwing the spacers 6 firmly in the connecting pieces 5, whereby in this case this rabbet 26 determines the maximum travel of the screw connections 13-15.

The connecting pieces 5 are provided with a disk-shaped section 14 that plays the role of intermediate disk 14 on which one or more wings 27 are provided extending radially on one side, that taper sharply in an axial direction from their base on the disk 14 to a sharp edge 28.

The assembly of a partition 3 with these alternative connecting pieces 5 and spacers 6 is analogous to that described above and is illustrated in FIG. 16 where it can be seen that the wings 27 of the connecting piece 5, when screwing in the next spacer 6 and the connecting piece to fasten the next beam 4, is pulled in an axial direction in the wood of the next beam 4, such that these wings 27 thus form means 17 to prevent the turning of the connecting pieces 5 when assembling the partition 3.

FIG. 16 shows the situation whereby the wood of the beams 4 has a wood moisture content at which the clear width of the beams 4 is exactly equal to the distance between the intermediate disks 14 of the spacers 6 in the assembled and maximum screwed-in situation.

Figure 17:
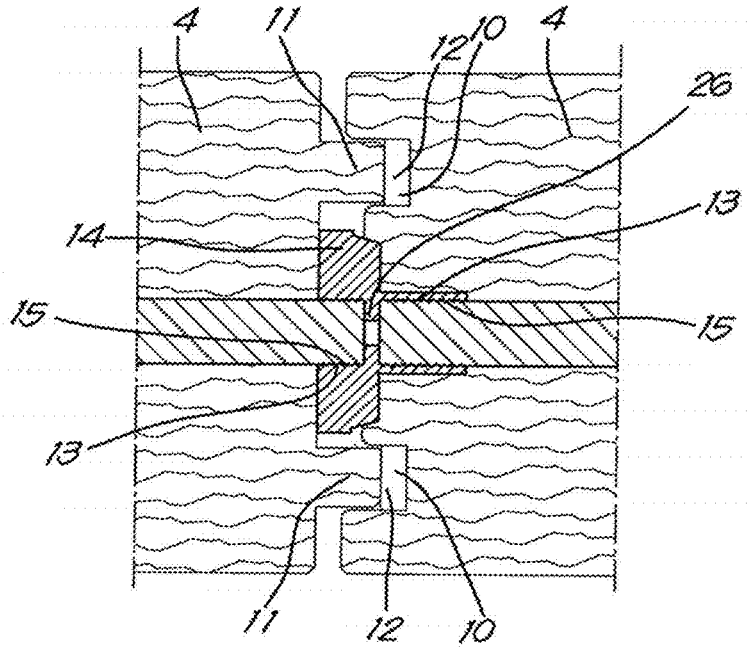
FIG. 17 shows a cross-section such as that of FIG. 16, but in a situation with a lower wood moisture content.

On the other hand FIG. 17 shows a situation with a lower wood moisture content, whereby the beams 4 have contracted widthways somewhat and the clearance between the beams 4 has thereby increased somewhat, but remains localised at the location of the disk 14 of the spacers 5.

Figure 18:
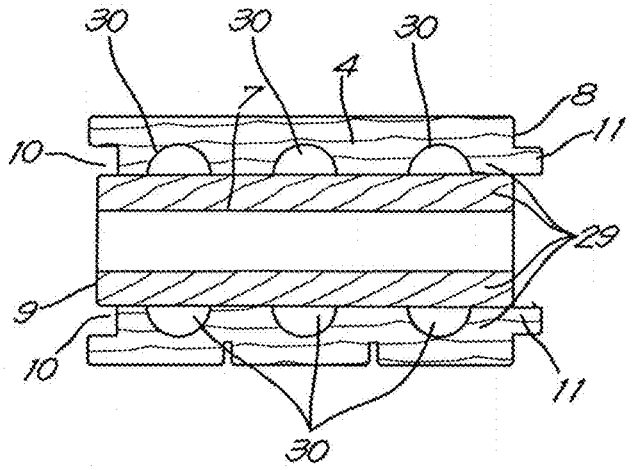
FIG. 18 shows a cross-section of a beam according to an alternative embodiment.

FIG. 18 shows a cross-section of a beam 18 consisting of three layers 29 that are laminated in the longitudinal direction of the beam 18 and in which passages 30 are provided that extend in the longitudinal direction of the beam 4 and which can be used for affixing cables and pipes for utility services.

Figure 19:
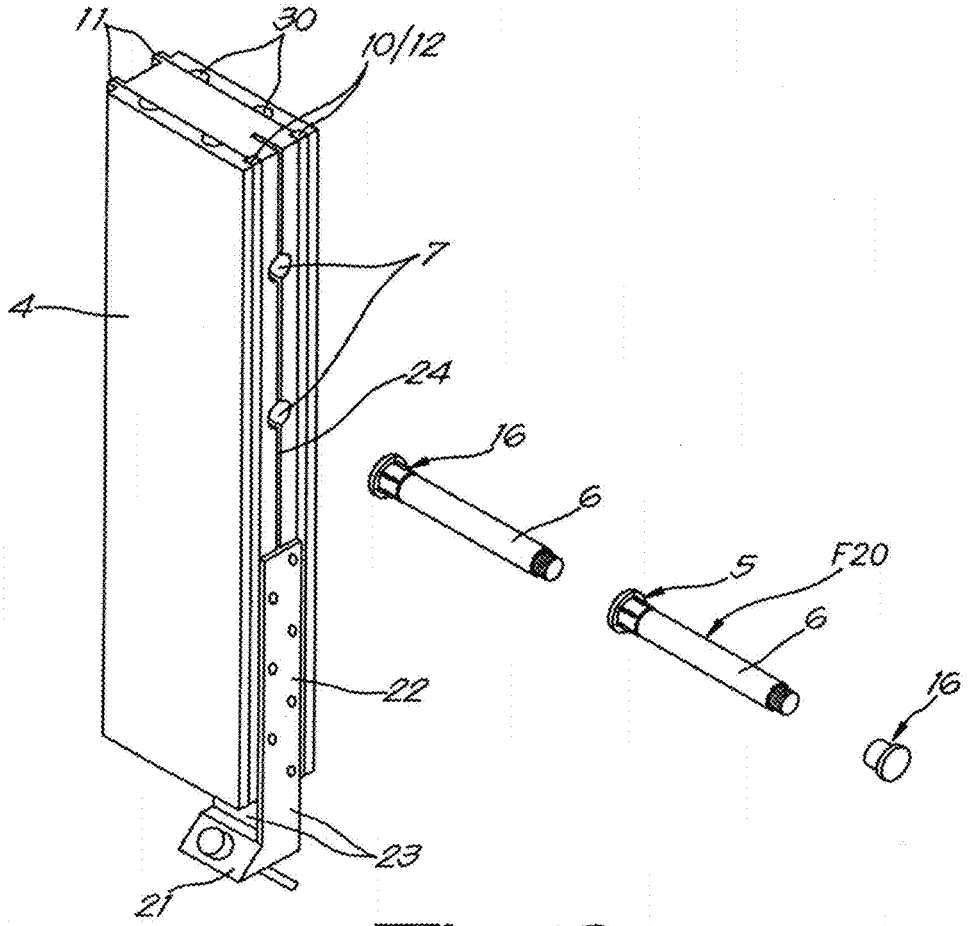
FIG. 19 shows a perspective view of the constituent components of a partition system according to the invention in one preferred embodiment.
Figure 20:
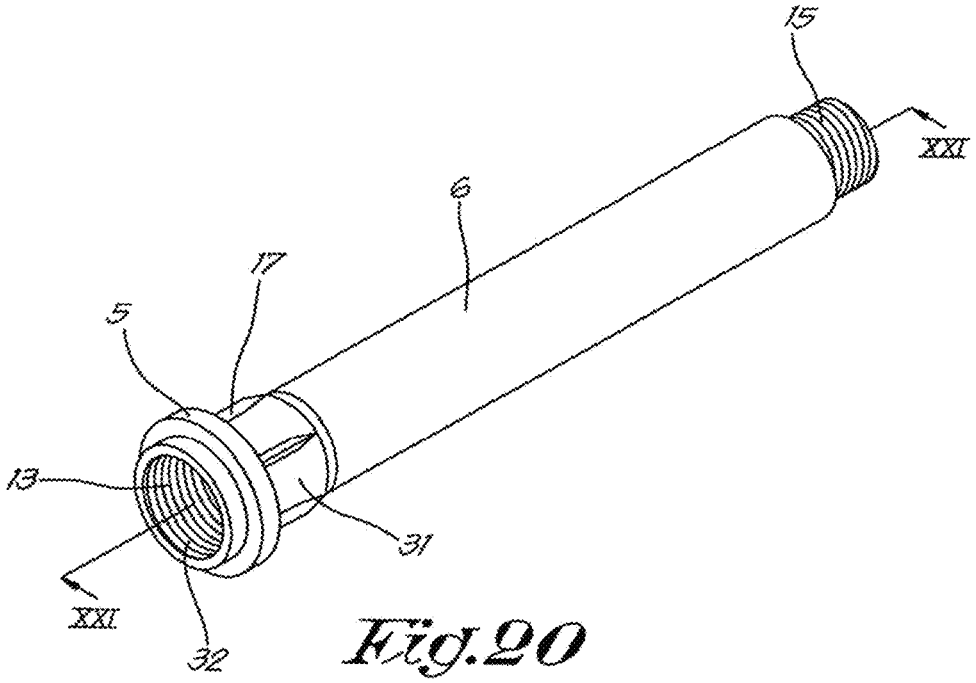
FIG. 20 shows the coupling piece indicated by F20 in FIG. 19.
Figure 21:
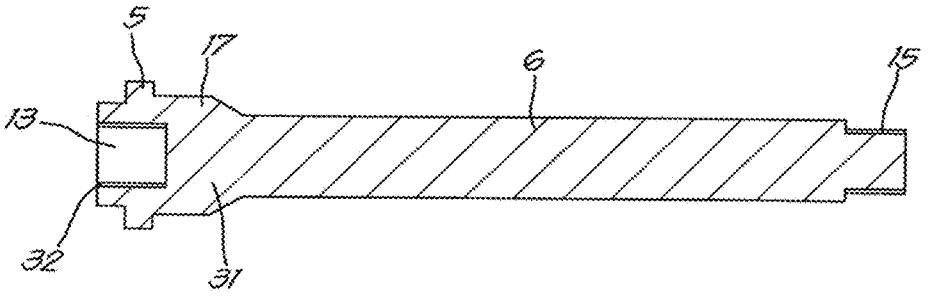
FIG. 21 shows a cross-section according to line XXI-XXI.

FIG. 19 shows an example of the components of a partition system according to the invention in one of the intended embodiments, albeit with a shortened beam 4 to be fitted below a window for example. The coupling pieces 6 used in this case are constructed somewhat differently to the previous embodiments and in this case are formed by a solid steel bar which, as shown in greater detail in FIGS. 20 and 21, is provided at one end with an axial tenon of a somewhat smaller diameter and provided with an external screw thread section 15, and at the other end is provided with a thickened head 31 with a somewhat larger diameter, and with an axial drill hole 32 therein with an internal screw thread section 13 to be able to engage with a screw thread section 15 of another coupling piece 6.

A pinion is provided at a short axial distance from the end of the head 31 that is intended to be used as a connecting piece 5 between the beams 4.

The means 17 for preventing the turning of the coupling pieces 6 when screwing the coupling pieces 6 into one another, are in this case axial wings 27 that are pulled in the wood of the beams when screwing in the coupling pieces 6.

An advantage of this embodiment is that the coupling pieces and connecting pieces are integrated into one component and fewer separate components are thus needed to compose a partition, which makes the assembly of a partition easier as fewer components have to be fitted.

A dimensionally stable partition construction is thus obtained with transverse steel shafts composed of coupling pieces screwed into one another. The cumulative length of the coupling pieces keeps the total length of the thus formed partition stable, while each beam separately can freely expand and contract according to the humidity. The compressible seals 12 keep the assembly airtight.

Preferably each beam 4 of the partition 3 is flanked by two connecting pieces 5, although two or more beams 4 between two successive connecting pieces 5 can be provided.

Figure 22:
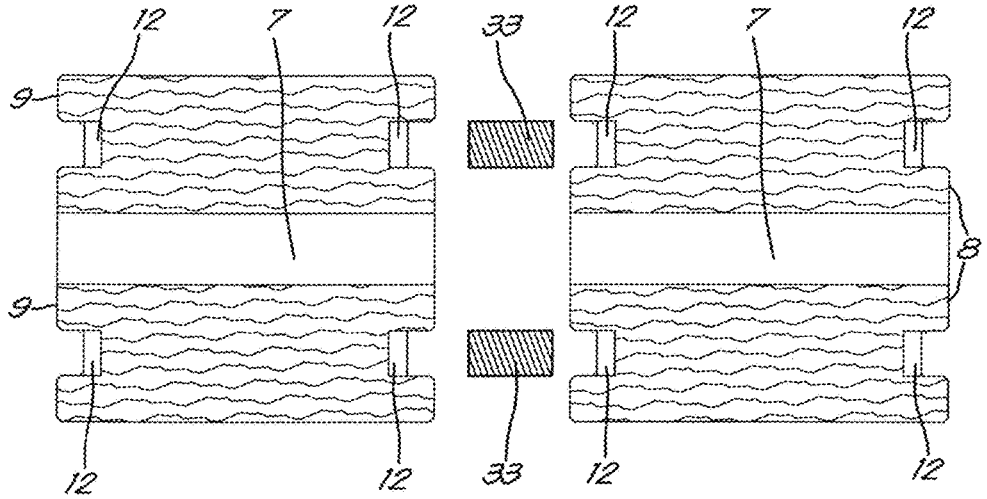
FIGS. 22 and 23 show a cross-section such as that of FIG. 8, but each for a variant embodiment of a partition system in an unassembled state and without connecting pieces.

Depending on the place of application and the desired embodiment of the partition system the tongues and grooves can be omitted, as shown in FIG. 22, whereby in this case the beams 4 are finished with a flat head face 8 and tail face 9 and whereby the head faces are provided with one or more seals 12.

It is clear that in this case cheaper beams without profiled partitions 8 and 9 can be used, which also makes the partition system cheaper.

With this cheaper embodiment the seals 12 remain visible, which however in the case of a floor for example is of little importance when it still has to be provided with a covering.

Figure 23:
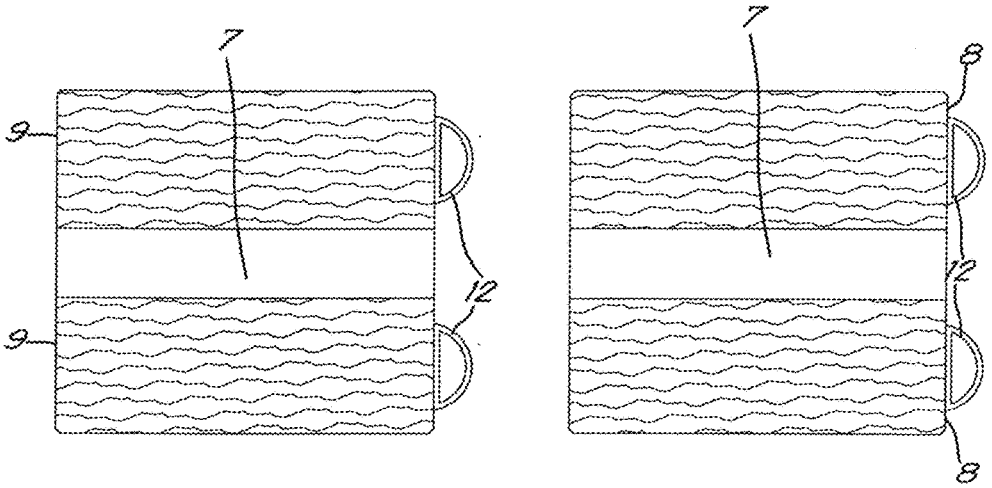

Alternatively, as shown in FIG. 23, the head face 8 and the tail face 9 are both provided with grooves 10 in which a common slat 33 can be held, which acts as a floating double tongue as it were.

It is clear that the coupling pieces 6 can also be coupled together in other ways than with screw thread connections, for example with a screw connection of the bayonet coupling type, or with a snap connection or similar.

The present invention is by no means limited to the embodiments described as an example and shown in the drawings, but a partition or sheet according to the invention can be realised in all kinds of forms and dimensions, without departing from the scope of the invention.

The invention claimed is:

1. Partition system for assembling a partition (3), in particular a wall, floor, ceiling or sheet, that is composed of wooden beams (4) with two side faces (8,9) opposite one another extending in the longitudinal direction that determine a width (B) of the wooden beam (4), respectively a head face (8) and a tail face (9) with which the wooden beams (4) can be assembled adjacent or next to one another and which can be coupled together by connecting pieces (5) that are affixed between adjacent wooden beams (4) and which are connected together by coupling pieces (6) that extend through passages in the beams in line with one another, wherein the connecting pieces (5) comprise an intermediate disk (14), whereby the intermediate disks (14) are provided to be fitted between the side faces (8,9) of adjacent beams (4) in order to keep the wooden beams (4) from one another with a certain clearance (S) in the assembled state in order to provide room for the wooden beams (4) to be able to expand widthways at the location of the clearances (S) and whereby the coupling pieces (6) are constructed as spacers (6) between the connecting pieces (5) to ensure that the intermediate disks (14) are kept at a predetermined fixed distance or practically fixed distance from one another, the predetermined fixed distance being the width of the wooden beam (4) at a given wood moisture content between 9% and 11%.

2. Partition system according to claim 1, wherein the clearance (S) between the beams (4) are determined by the thickness (d) of the intermediate disks (14) and that the thickness (d) is between 1% and 3% of the width (B) of the beams (4) at a level of the passages.

3. Partition system according to claim 1, wherein the intermediate disks (14) are dimensioned such that when the width (B) of the beams (4) at a level of the passages (7) becomes larger than the predetermined fixed distance between the intermediate disks (14) due to expansion, these intermediate disks (14) can push in the material of the beams (4).

4. Partition system according to claim 1, wherein the coupling pieces (6) are constructed such that, the given wood moisture content and in an unassembled state of the partition (3), the predetermined distance between two successive intermediate disks (14) on either side of a particular wooden beam (4) is equal to the width (B) of the particular beam (4) at the location of the passages (7).

5. Partition system according to claim 4, wherein the given wood moisture content at which the width (B) of the particular wooden beam (4) at the location of the passages (7) is determined, is between the 9% and 11% wood moisture content.

6. Partition system according to claim 1, wherein the coupling pieces (6) and the connecting pieces (5) are connected together by a screw connection with a maximum travel that is such that the predetermined distance between the intermediate disks (14) is reached when the coupling pieces (6) and connecting pieces (5) are screwed into one another over their maximum travel.

7. Partition system according to claim 6, wherein the coupling pieces (6) are formed by a rod that is provided with screw thread sections (13,15) at its ends that can engage with screw thread sections (13,15) that are provided for this purpose on the connecting pieces (5) on either side of the beam (4).

8. Partition system according to claim 6, wherein the intermediate disk (14) is a ring, and the connecting pieces (5) are formed the ring and by two coaxial screw thread sections (13, 15), and the coupling pieces (6) are formed by a threaded rod with an external thread or a threaded tube with an internal thread by which the threaded rod or the threaded tube is screwed to a connecting piece (5).

9. Partition system according to claim 1, wherein the beams (4) are provided with a series of passages (7) that are at a fixed distance from one another such that the beams (4) in the partition (3) can be affixed with respect to one another in such a way that the passages (7) extend in line with one another.

10. Partition system according to claim 9, wherein in the assembled state of the partition (3), the beams (4) of the partition (3) are held together by a series of coupling pieces (6) that connect the connecting pieces (5) together and which extend through the passages (7) in line with one another over the width of a number of beams (4).

11. Partition system according to claim 6, wherein the connecting pieces (5) are provided with elements (17) preventing the turning of the connecting pieces (5) when screwing the coupling pieces (6) tight when assembling the partition (3).

12. Partition system according to claim 11, wherein the elements (17) are formed by a nut (18) that is connected in an unturnable way with the screw thread sections (13,15) of the connecting piece (5) and whose external diameter (F) is greater than the internal diameter (A) of the passage (7) in a beam (4).

13. Partition system according to claim 11, wherein the elements (17) are formed by one or more wings (27) that extend radially on one side of the intermediate disk (14) of the connecting pieces (5).

14. Partition system according to claim 13, wherein the wings (27) taper sharply in an axial direction from their base on the intermediate disk (14).

15. Partition system according to claim 1, wherein the tail face (9) of each beam (4) is provided with at least one groove (10) and the head face (8) is provided with at least one tongue (11), whereby the tongue (11) and groove (10) have a complementary shape, such that the groove (10) and tongue (11) can engage with a respective tongue (11) and groove (10) of a similar adjacent beam (4) to form the partition (3).

16. Partition system according to claim 15, wherein between each tongue (11) and groove (10) that engage with one another in the widthways direction of the beam (4) a clearance is provided that is of the same order of magnitude as the thickness of the intermediate disks (14) or is equal to it.

17. Partition system according to claim 15, wherein the grooves (10) and tongues (11) extend over the entire length (1) or practically the entire length of the beam (4).

18. Partition system according to claim 15, wherein a seal (12) is provided between a tongue (11) and groove (10) that extends over the length of the groove (10) and which is made of an elastic compressible material.

19. Partition system according to claim 15, wherein each connecting piece (5) in the assembled state of the partition (3) is located between two tongues (11) of a head face (8).

20. Partition system according to claim 1, wherein the wooden beams (4) are made of solid wood or of laminated wood in one direction.

21. Partition system according to claim 1, wherein the connecting pieces (5) and/or the coupling pieces (6) are made of metal or another dimensionally stable material whose dimensions are not sensitive to the effects of moisture.

22. Partition of a building that is assembled with a partition system according to claim 1, wherein the partition (3) is composed of beams (4) that are erected in their vertical length with horizontal passages (7) that extend in line with one another and which are connected by means of at least two series of connecting pieces (5) and coupling pieces (6), with each series at a different height of the partition (3).

23. Partition according to claim 22, wherein the length of the beams (4) is sufficient to be able to span the entire height of a storey of a building.

* * * * *